US006682074B2

(12) United States Patent
Weston

(10) Patent No.: US 6,682,074 B2
(45) Date of Patent: Jan. 27, 2004

(54) INTERACTIVE TREASURE HUNT GAME

(75) Inventor: Denise Chapman Weston, Wakefield, RI (US)

(73) Assignee: Creative Kingdoms, LLC, Wakefield, RI (US)

( * ) Notice: Subject to any disclaimer, the term of this patent is extended or adjusted under 35 U.S.C. 154(b) by 0 days.

(21) Appl. No.: 10/014,330

(22) Filed: Dec. 11, 2001

(65) Prior Publication Data

US 2003/0107178 A1 Jun. 12, 2003

(51) Int. Cl.[7] ..... A63B 71/00
(52) U.S. Cl. ..... 273/459; 273/153 R
(58) Field of Search ..... 273/440, 444, 273/459, 461; 283/72, 49

(56) References Cited

U.S. PATENT DOCUMENTS

| | | | | |
|---|---|---|---|---|
| 5,236,200 A | * | 8/1993 | McGregor et al. | 273/459 |
| 5,835,576 A | * | 11/1998 | Katz | 379/93.13 |
| 5,924,695 A | * | 7/1999 | Heykoop | 273/459 |
| 6,234,803 B1 | * | 5/2001 | Watkins | 434/156 |
| 6,254,101 B1 | * | 7/2001 | Young | 273/460 |
| 6,273,425 B1 | * | 8/2001 | Westfall et al. | 273/459 |

* cited by examiner

*Primary Examiner*—Raleigh W. Chiu
(74) *Attorney, Agent, or Firm*—Jonathan A. Barney

(57) ABSTRACT

An interactive treasure hunt game played in a public forum that includes interactive clue sources and personal game pieces and which allows for play by multiple, contemporaneous or consecutive players and encourages player interaction to prevent non-participants from entering the game.

21 Claims, 13 Drawing Sheets

INTERACTIVE TREASURE HUNT GAME

BACKGROUND OF THE INVENTION

1. Field of the Invention

The present invention relates to a game of treasure hunt. In particular, the present invention relates to an interactive treasure hunt game whereby players interactively seek out and uncover clues hidden at various locations within an entertainment or educational facility.

2. Description of the Related Art

A traditional "treasure hunt" is a game in which clues are placed at various physical locations, with each successive clue at least hinting at the location of the next clue, and the final clue at least hinting at the location of a hidden "treasure" or prize. Someone is responsible for hiding the prize, formulating the clues, and placing them in various locations. Players then search out and solve the clues in order to find the prize.

Variations on the game include using a map created by the person that hides the prize. Paces or steps may be drawn in on the map, and the prize may even be buried in the ground. Other variations of the game include board games where the players solve clues and move characters by rolling dice or some other method.

The traditional "treasure hunt" game is usually a privately organized one-time event. Clues are often written on small pieces of paper and then hidden. Players find the clues, read them, and then take or discard them. The clues may or may not remain in their hidden location, depending on how the game is played.

Although many people enjoy a good treasure hunt, it is often time consuming and difficult to prepare one. It is challenging to think of clever clues and hiding locations. The skill level of the player must also be taken into account in creating the clues and choosing their locations. Often, the time spent in preparation for a treasure hunt greatly exceeds the time it takes to play and solve the game. There have been some innovations that may assist someone preparing a treasure hunt game. For example, there are cards with pre-printed clues and locations so that the person preparing the game can simply place the clues and hide the prize. However, such treasure hunt games are not well suited for playing within a public facility.

SUMMARY OF THE INVENTION

The present invention recognizes the desirability of playing a pre-set treasure hunt game in a public facility such as a family entertainment center or an amusement park. In this manner, participants may go to a facility and participate, or observe friends or relatives participating, in a treasure hunt without having to prepare anything at all. In the traditional "treasure hunt" game, the player finds the clue, picks it up, reads it off the paper, and moves on to the next clue. The player takes no action other than to move on to the next location. But, if a treasure hunt is played in a public location, some outside individual could find a clue and begin playing the game against the wishes of the person who created or runs the game. Unintended participants could diminish the fun of the game for the actual intended players. Thus, the present invention in one embodiment provides player interaction with clue sources to avoid the possibility that outsiders can enter the game.

In another embodiment, the present invention provides an interactive "treasure hunt" game, including a method of playing the interactive "treasure hunt" game. The game is primarily adapted for use in or at an entertainment or educational facility, but could be adapted to other settings. The facility provides personal game pieces, interactive clue sources, and prizes. Players come to the facility and play the interactive "treasure hunt" game. Thus, a treasure hunt game is provided that is easily repeated, so that different people can enjoy the hunt without duplicating the work of preparation.

Players are issued a personal game piece, which is a prepared game card or other item that will be carried with the player during the hunt. The player then retrieves a clue from the first interactive clue source. The interactive clue source is in a fixed location. The player cannot remove the clue source. It remains in place and is used as a clue source for multiple players over an extended period of time. This enables many people to enjoy the game without duplicating the work of preparation.

For increased entertainment value, the player interacts with the clue source in order to receive the clue. The level of interaction can vary depending upon the skill level of the players or the desired theme of the particular game. For example, in a "treasure hunt" designed for children, rather than just reading the clue off of a sign, it would be more fun to use colored-filter decoder glasses to read a clue which was hidden by a color screen on the clue source. This type of interaction also prevents unintended participants from entering the game. There are many different ways that players can interact with the clue sources that will be entertaining and will prevent outsiders from playing the game.

The nature of the clues is also important. In addition to at least hinting at the location of the next clue source, the clues may describe an action that the player should perform, or provide the player additional information. For example, a clue could instruct the player to scratch off or uncover a certain space on a personal game piece in order to help solve a puzzle, or in an educational facility, a player may receive interesting information related to nearby exhibits or about a game piece. If this information causes the player to interact with the personal game piece, unintended participants who are without a game piece will not likely enter the game. Providing information other than the location of the next clue increases the players' enjoyment of the game.

Players proceed from one clue source to the next, interacting with the clue sources to receive clues, performing the function or receiving information, and then searching out the next clue source. The clues may help the player solve a puzzle related to the personal game piece. Finally, at the end of the hunt, the player will receive a prize or reach the goal.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Having thus summarized the general nature of the invention and its essential features and advantages, certain preferred embodiments and modifications thereof will become apparent to those skilled in the art from the detailed description herein having reference to the figures that follow, of which.

DETAILED DESCRIPTION OF THE PREFERRED EMBODIMENT

Figure 1:
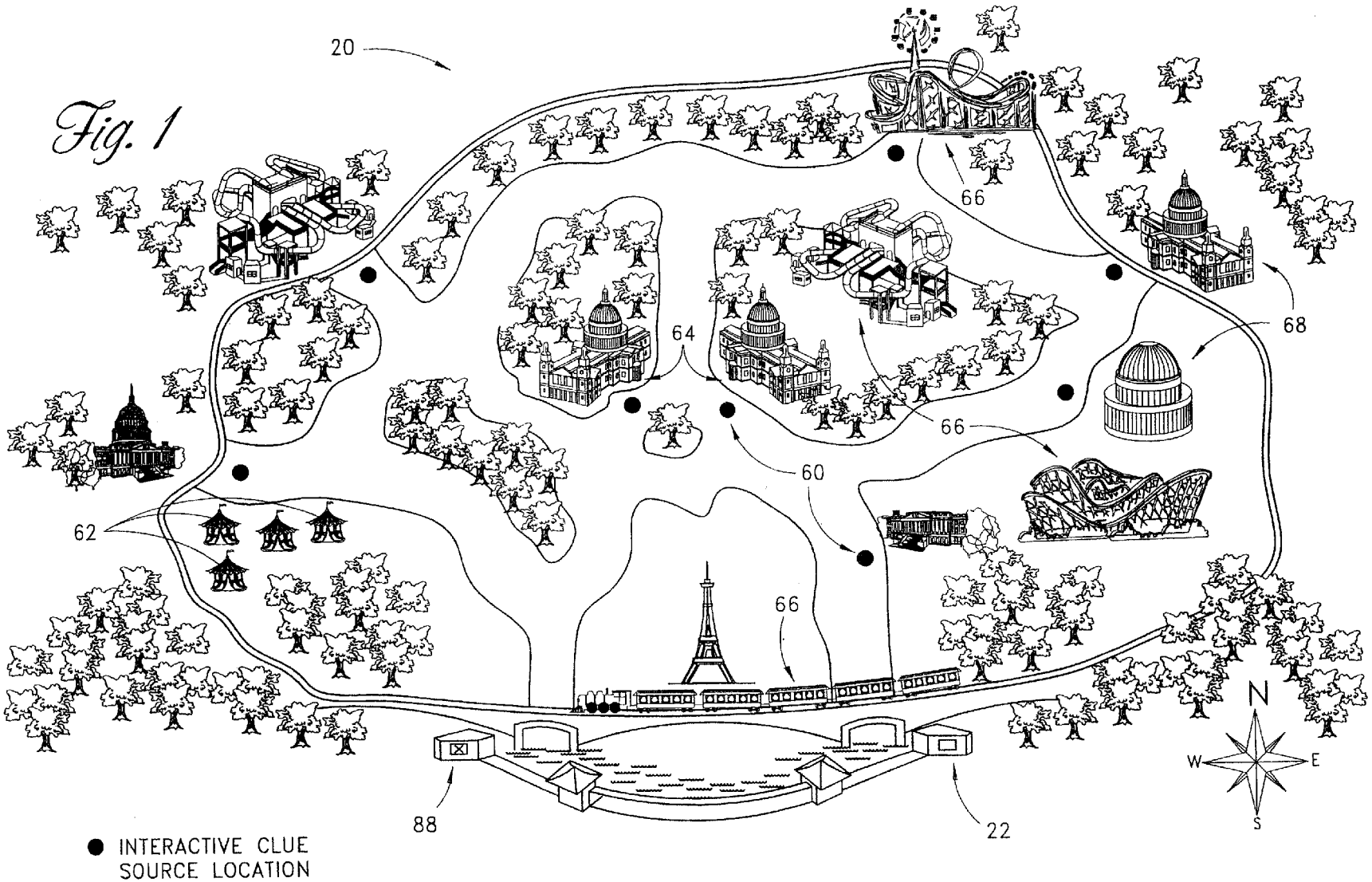
FIG. 1 is an aerial perspective view of one preferred embodiment of an interactive treasure hunt game situated within an amusement park facility.
Figure 2:
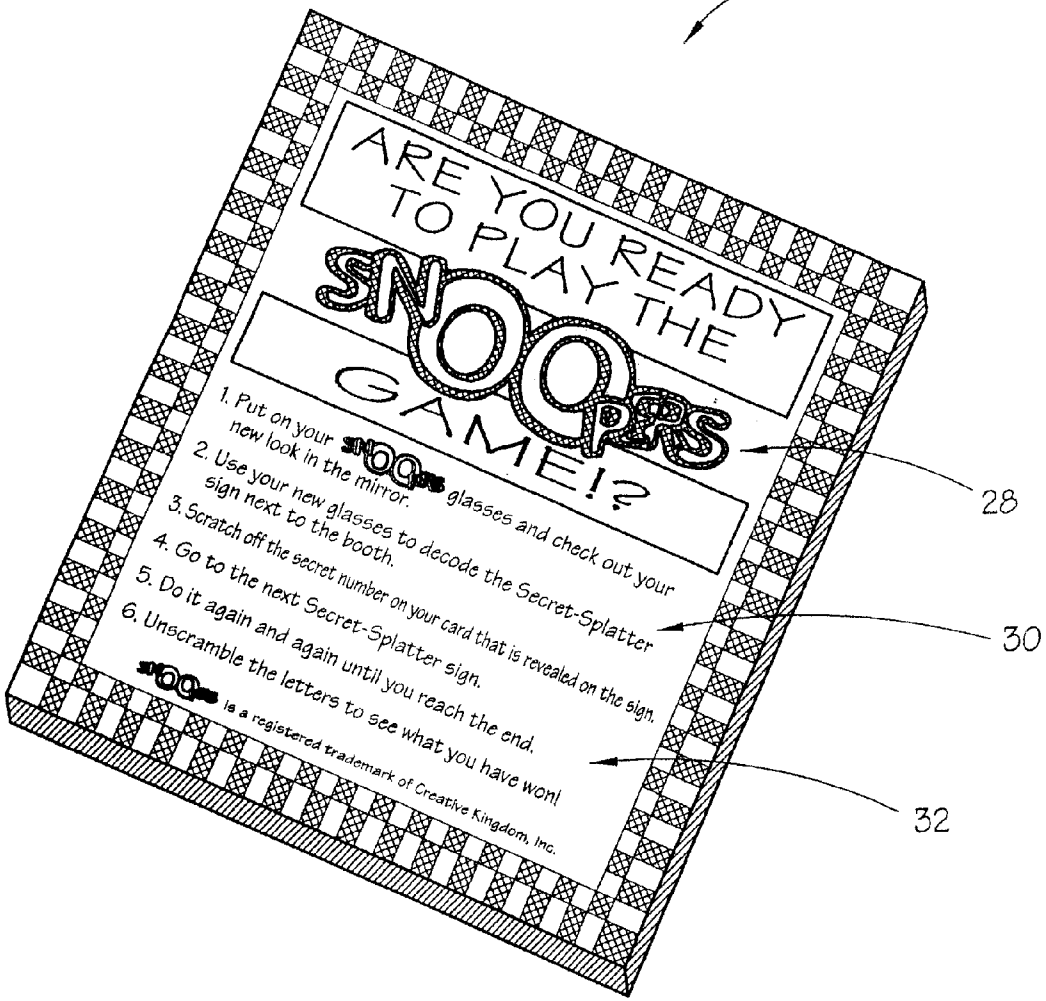
FIG. 2 is a top perspective view of a game card or personal game piece adapted for use with a preferred embodiment of the invention.
Figure 3B:
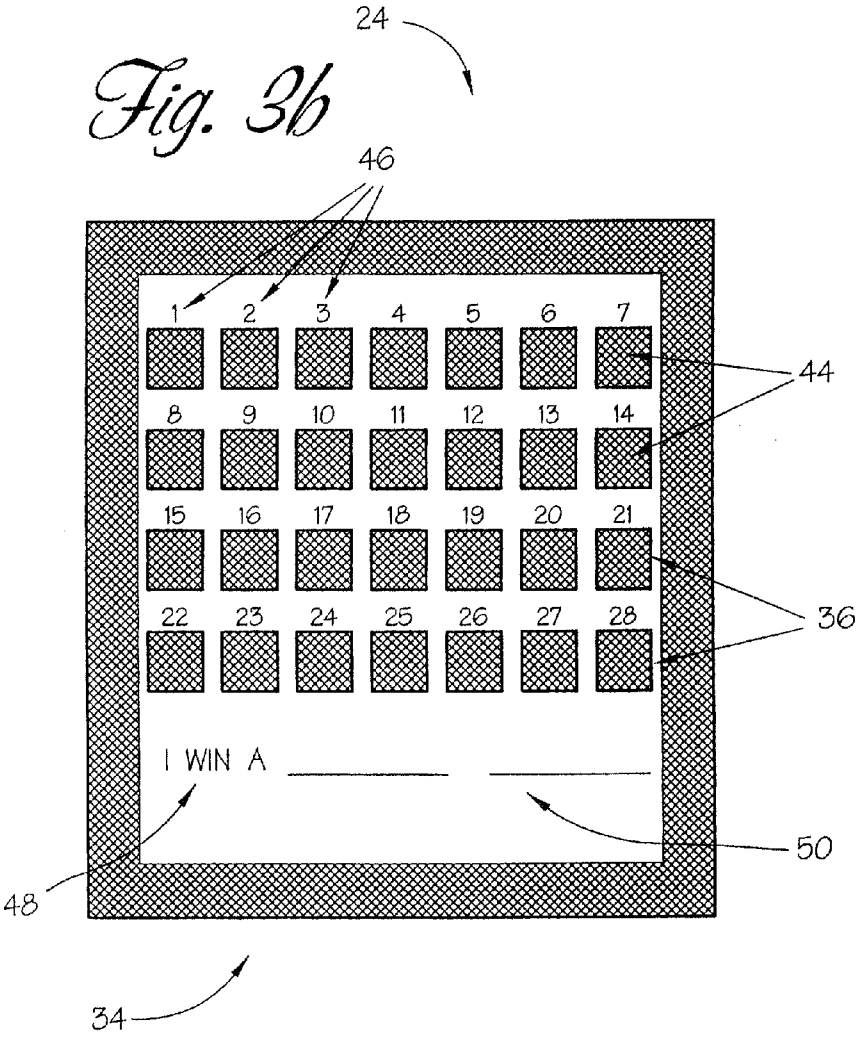
FIGS. 3A and 3B are front and back side views, respectively, of the game card of FIG. 2.
Figure 3A:
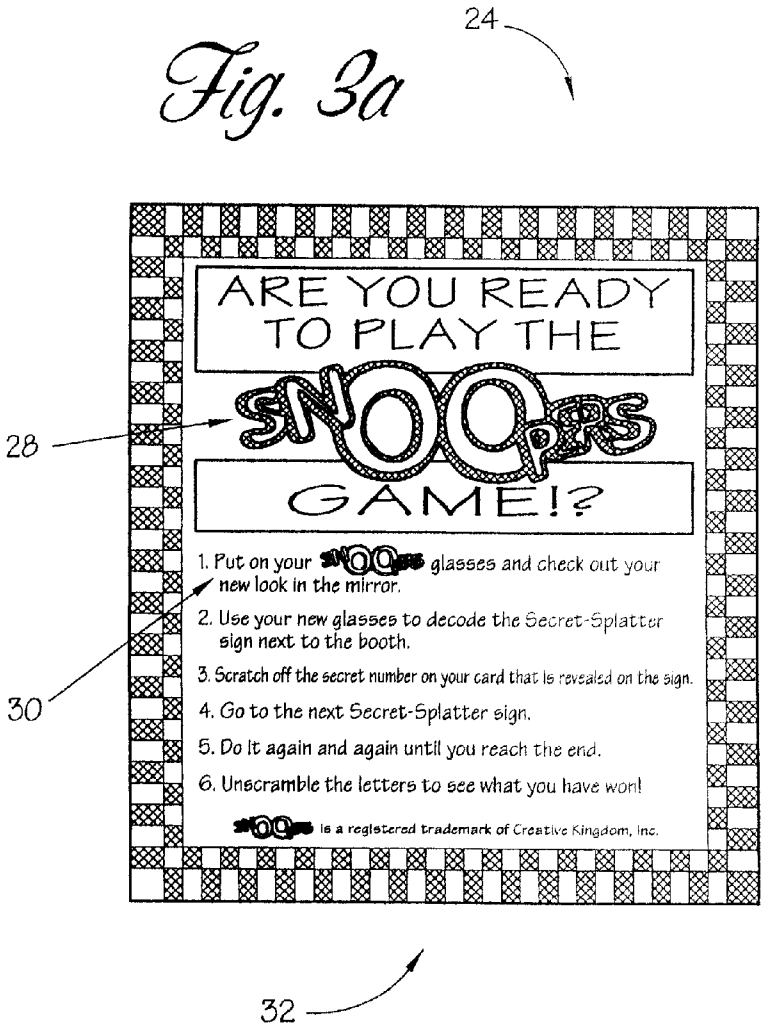
Figure 4B:
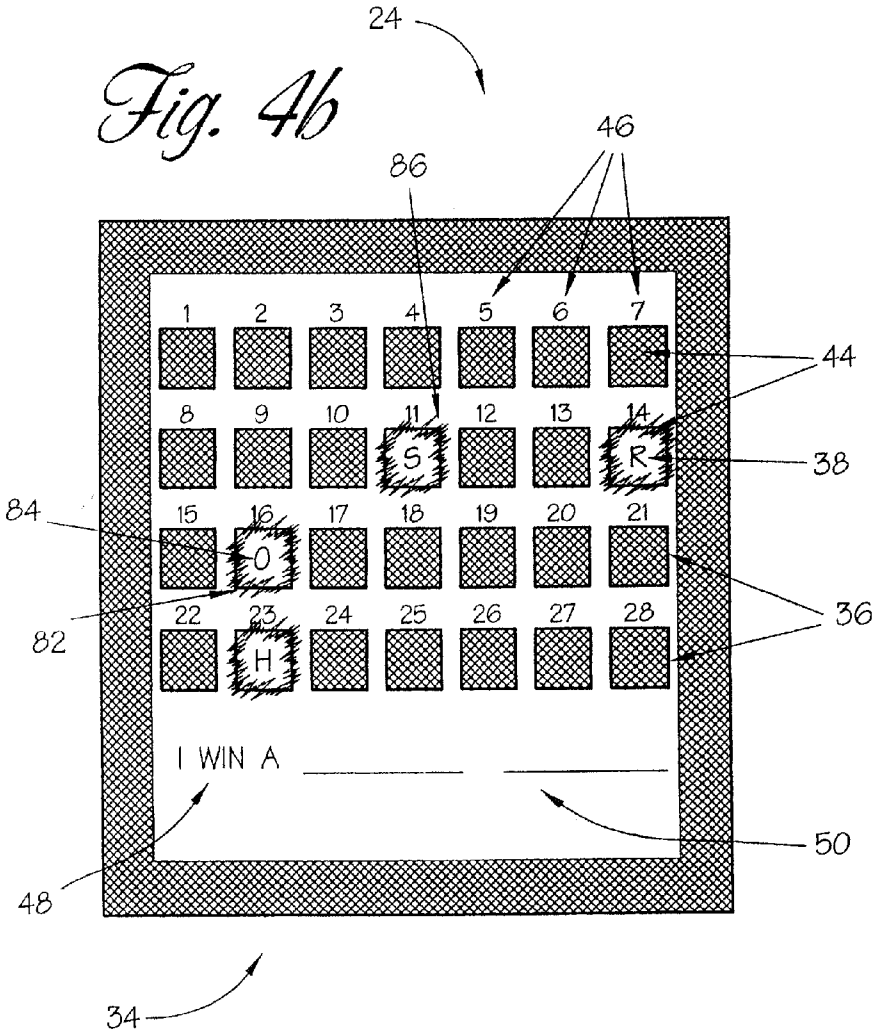
FIGS. 4A and 4B are front and back side views, respectively, of the game card of FIG. 2, with a majority of the spaces on the back side being covered by a scratch-off coating with four spaces being scratched off to reveal letters.
Figure 4A:
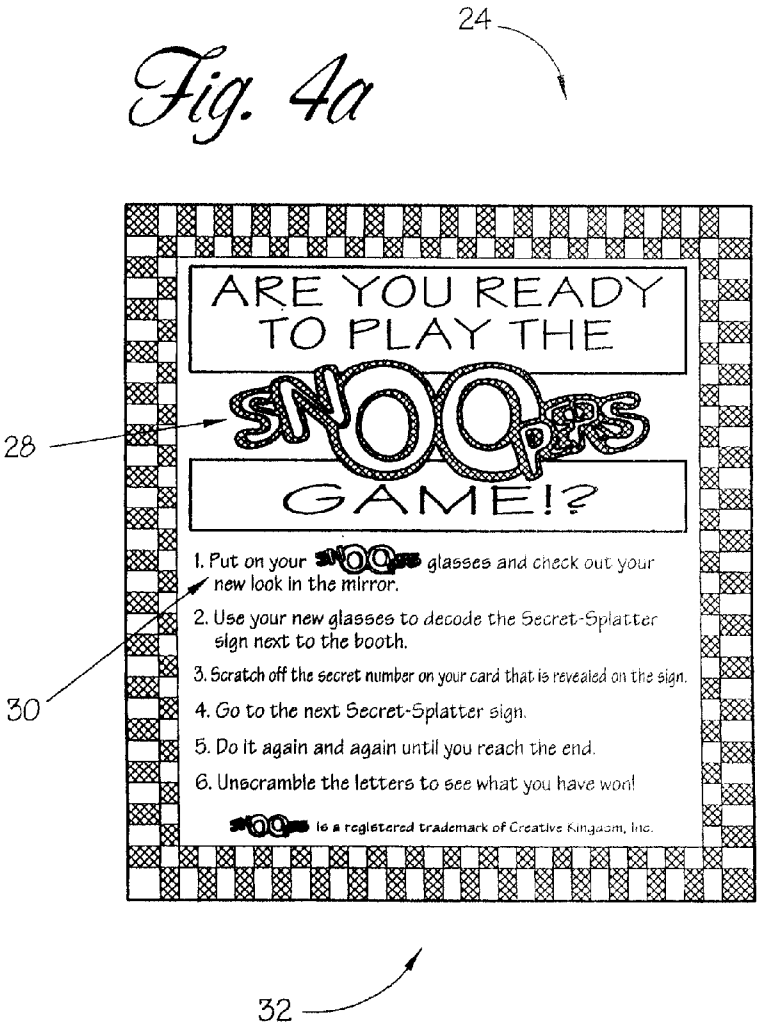
Figure 5B:
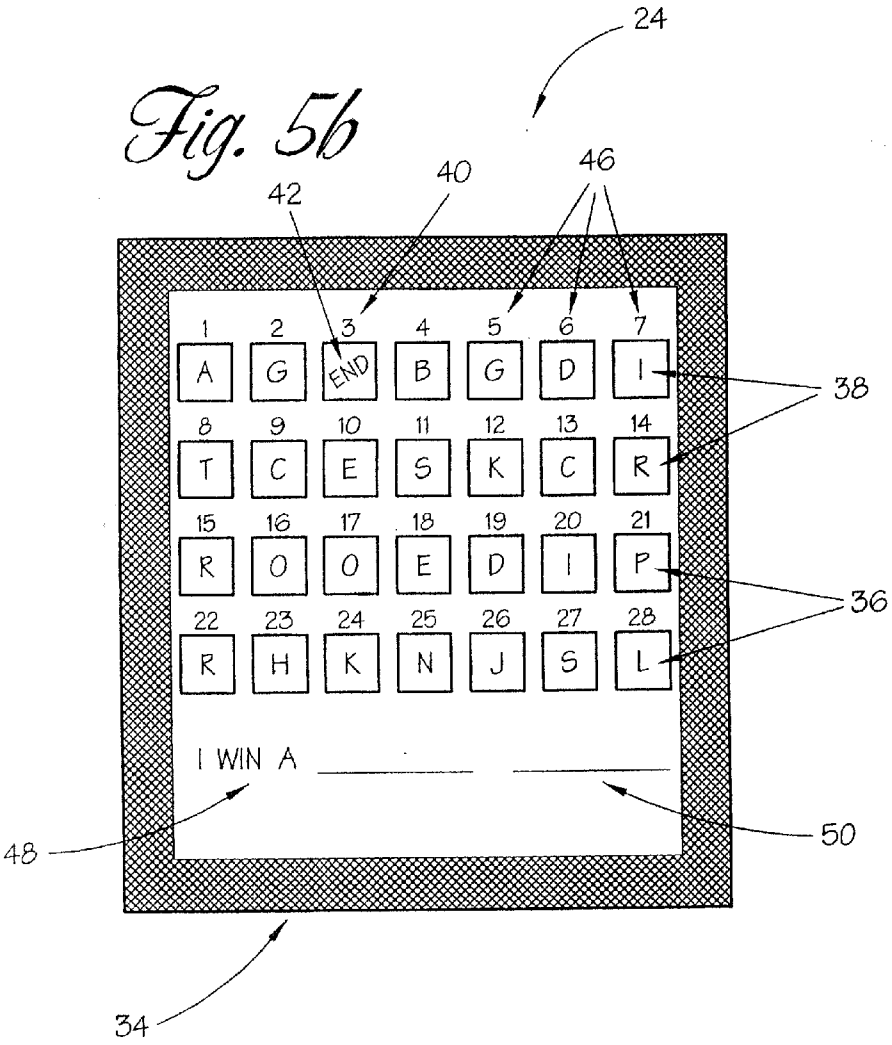
FIGS. 5A and 5B are front and back side views, respectively, of the game card of FIG. 2 before application of the scratch-off coating.
Figure 5A:
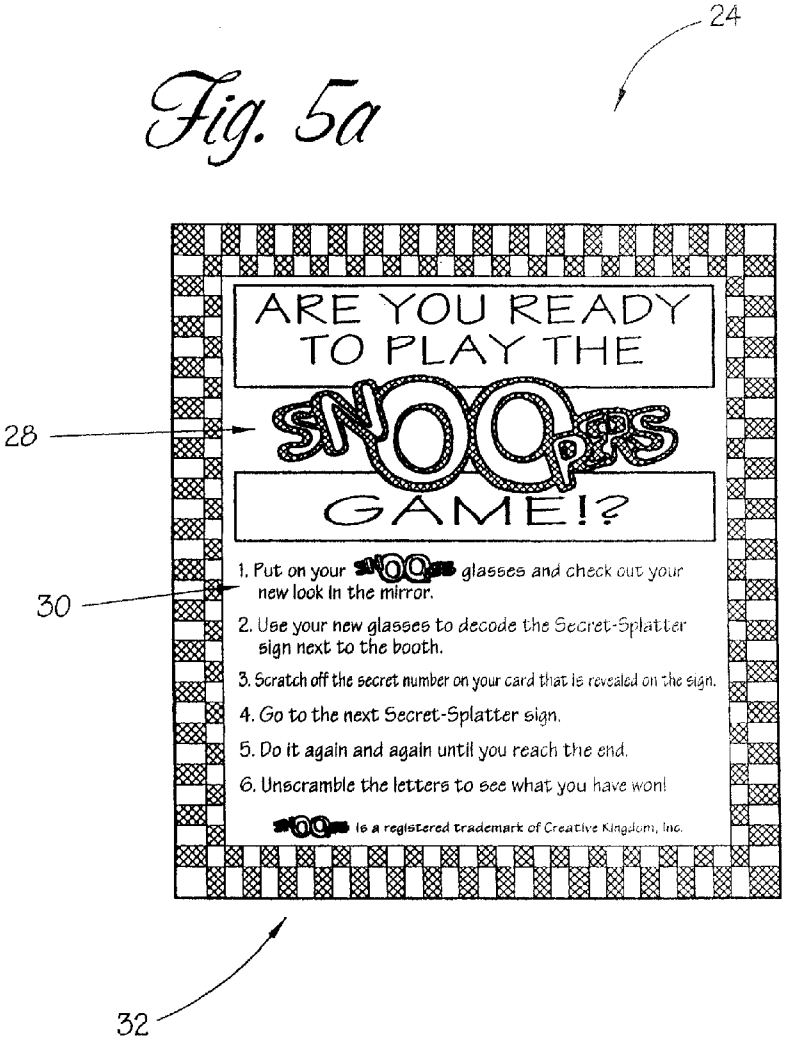

One preferred embodiment of the invention is illustrated in the Figures and described below. A treasure hunt game embodying the present invention is shown in FIG. 1. In this embodiment, the interactive treasure hunt game is played within an entertainment facility such as an amusement park 20. The amusement park 20 creates and establishes the interactive treasure hunt game within its facility. Players desiring to play the game come to the amusement park 20, go to a start booth 22 and pay a fee to play the game.

At the beginning of the game players receive one or more personal game pieces as illustrated in FIGS. 2–7. These game pieces 24,26 can be sold by an employee who works at the booth 22 or purchased from a machine. In this embodiment, the players receive a game card 24 and game glasses 26 as their personal game pieces. The game card 24 is made from paper or cardboard or any other convenient substrate. Preferably, it is approximately four inches square and about a sixteenth of an inch thick. The name 28 of the game and the game instructions 30 are printed on one side 32 of the card 24. On the other side 34 of the card there are twenty-eight spaces 36. Twenty-seven of the spaces 36 contain random letters 38 and one space 40 contains the word "END" 42. A scratch-off coating 44 covers each space 36 and the spaces are numbered 46 consecutively. Below the spaces are the words "I WIN A" 48 followed by blank lines 50. The game card 24 is a puzzle that the player solves in order to obtain a prize.

Figure 6:
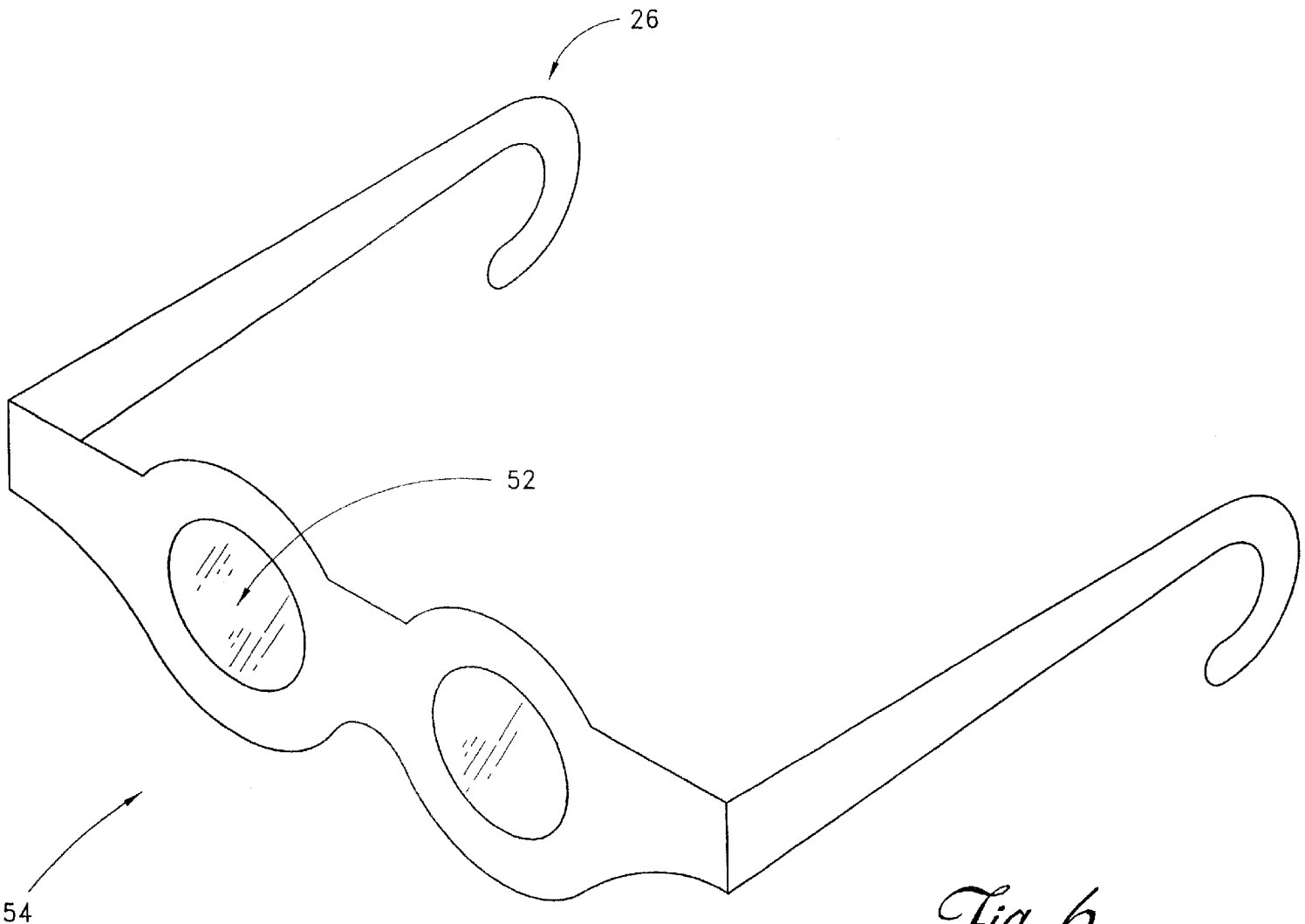
FIG. 6 is an isometric view of the game glasses, which is a personal game piece in the preferred embodiment of the invention.
Figure 7:
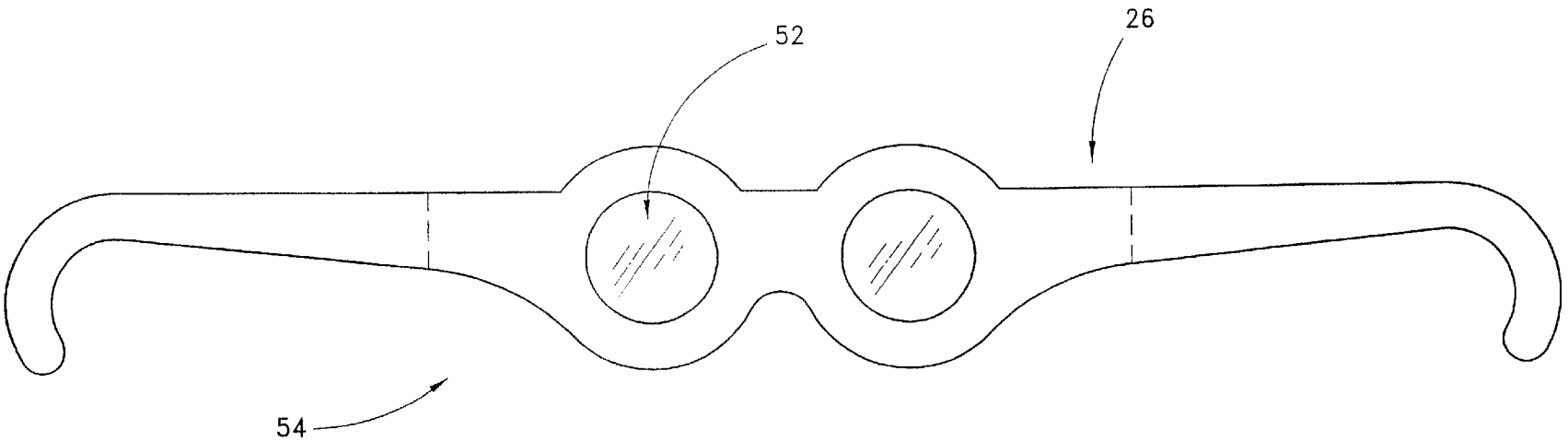
FIG. 7 is a front side view of the game glasses of FIG. 6.
Figure 8:
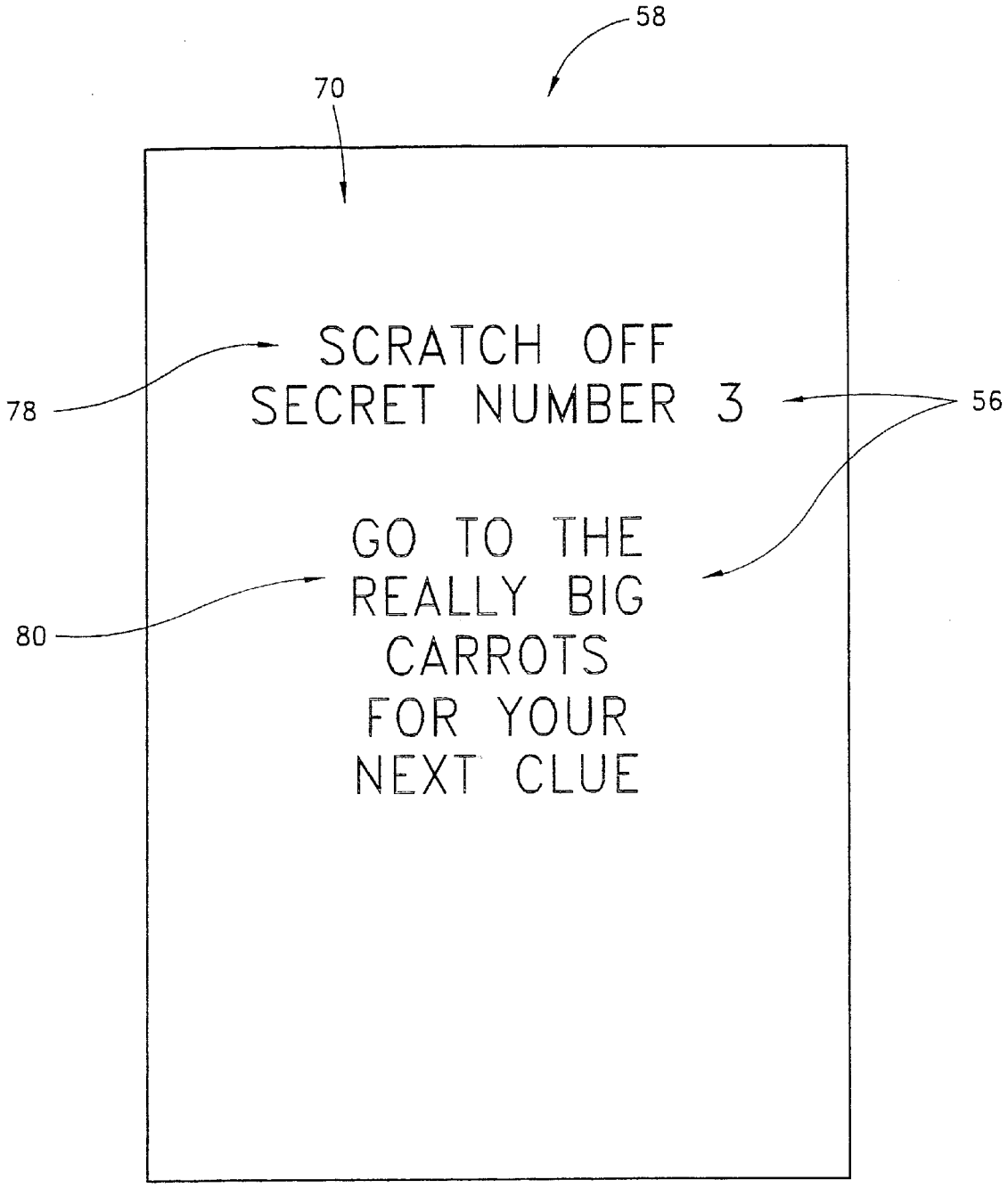
FIG. 8 is a front side view of a sign containing a clue, which is a portion of an interactive clue source in the preferred embodiment of the invention.

Referring now to FIGS. 6 and 7, the game glasses 26 may be disposable and are conveniently made from paper or cardboard. Non-disposable glasses may also be used. Preferably, they are decorated and colorful. The lenses 52 are made from red cellophane or other transparent colored material. When the glasses 26 are worn on the face of the player, the player sees everything in a red tint. The glasses 26 function as a colored-filer decoder 54 and assist the player in obtaining clues 56 from the interactive clue sources 58.

Figure 9:
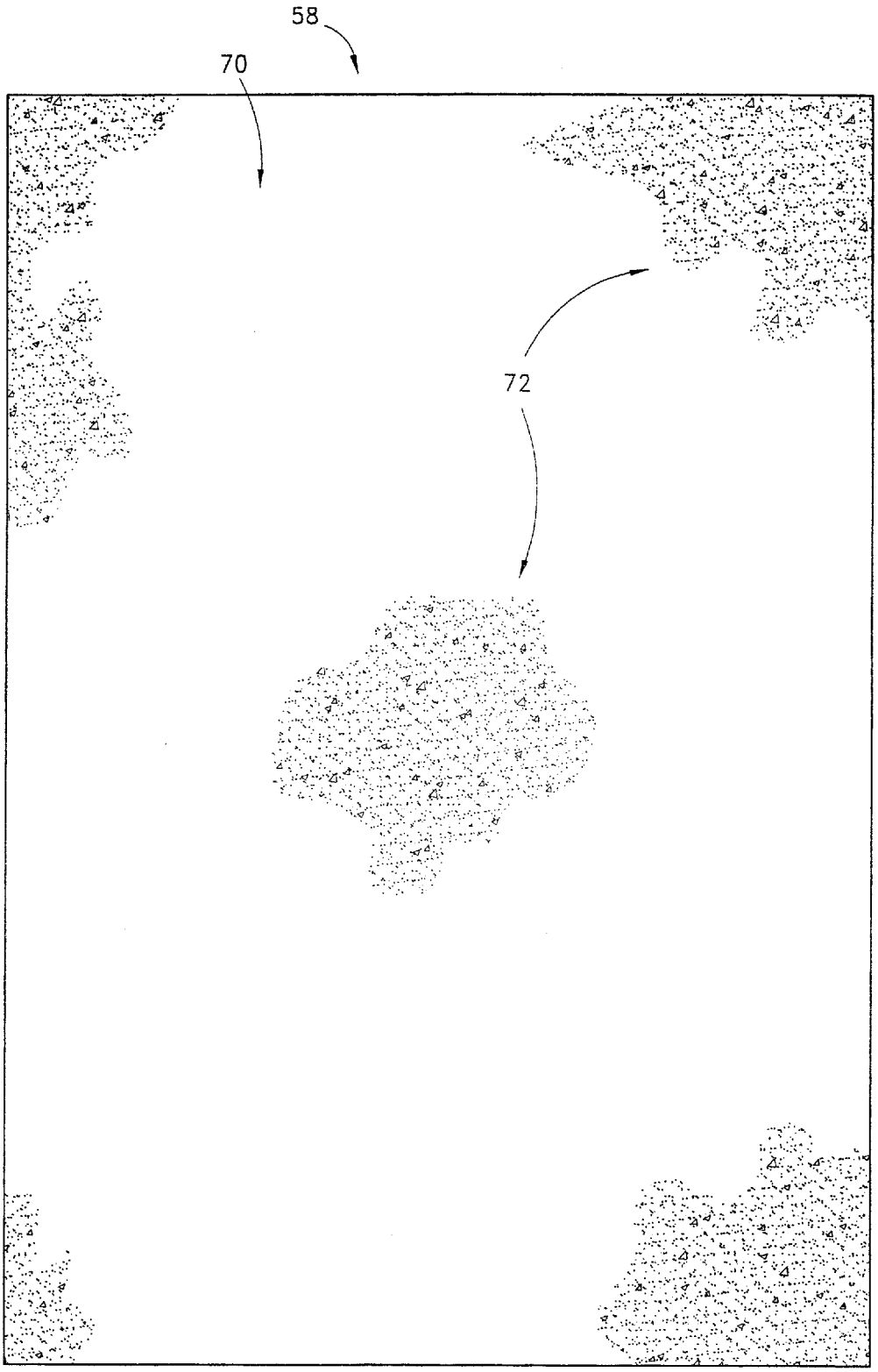
FIG. 9 is a front side view of the sign of FIG. 8 further containing a color screen pattern printed over the clue to hide it.
Figure 10:
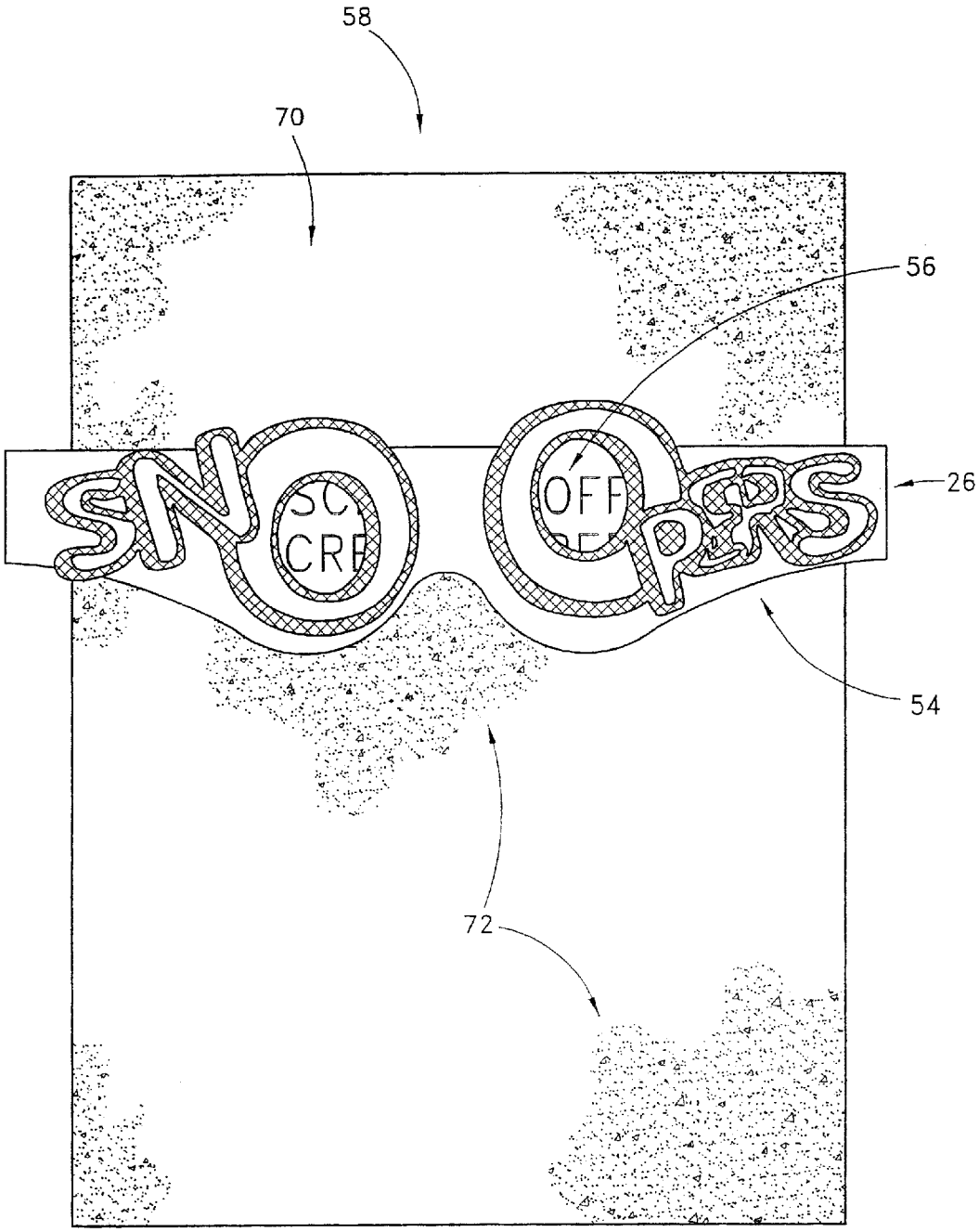
FIG. 10 is a front side view of the sign of FIG. 9 and the game glasses of FIG. 6, with the clue on the sign being visible looking through the lenses of the game glasses.
Figure 11:
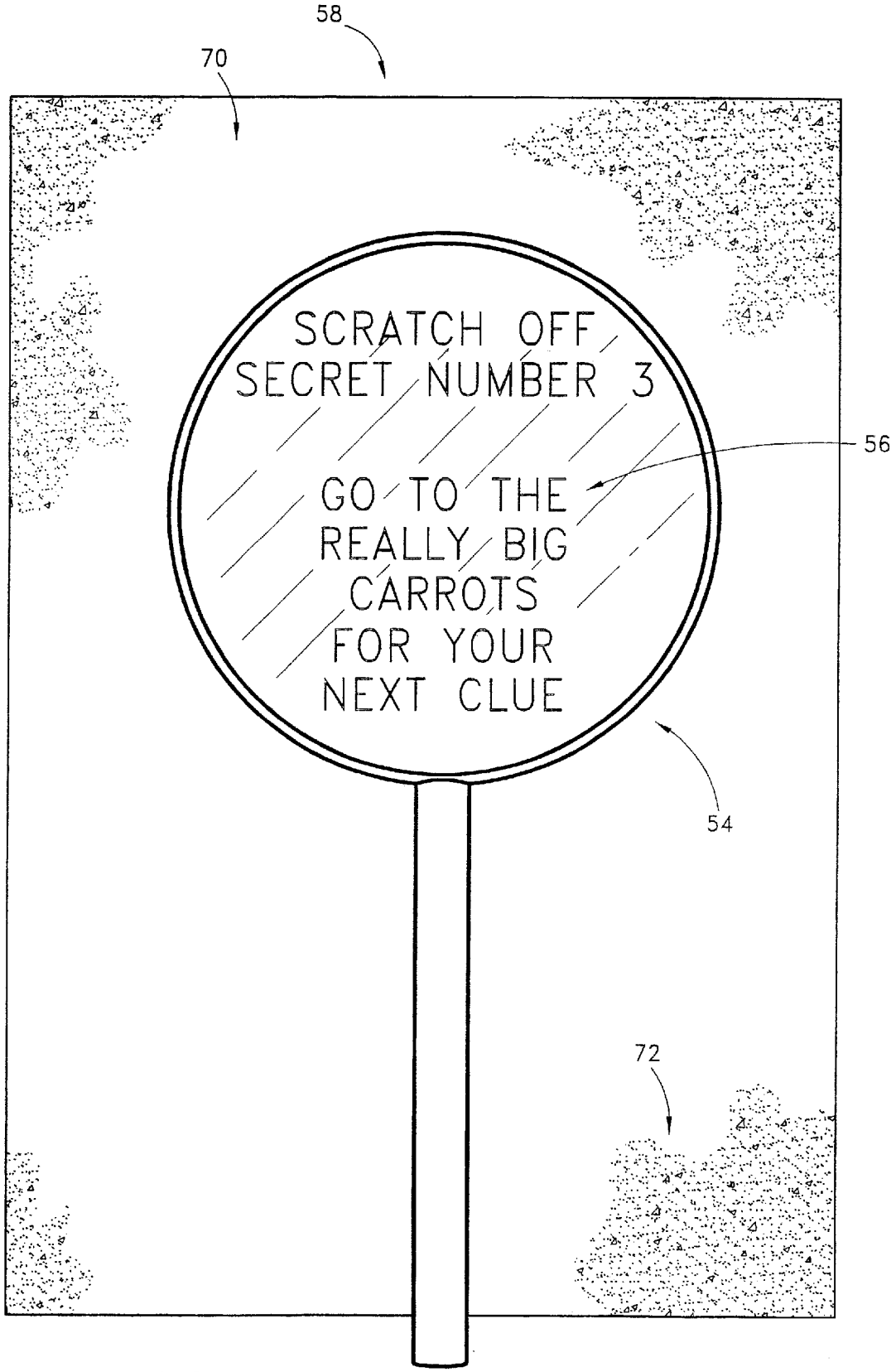
FIG. 11 is a front side view of the sign of FIG. 9 and a decoder glass, which is an alternative personal game piece to the game glasses of FIG. 6, with the clue on the sign being visible looking through the lens of the decoder glass.
Figure 12:
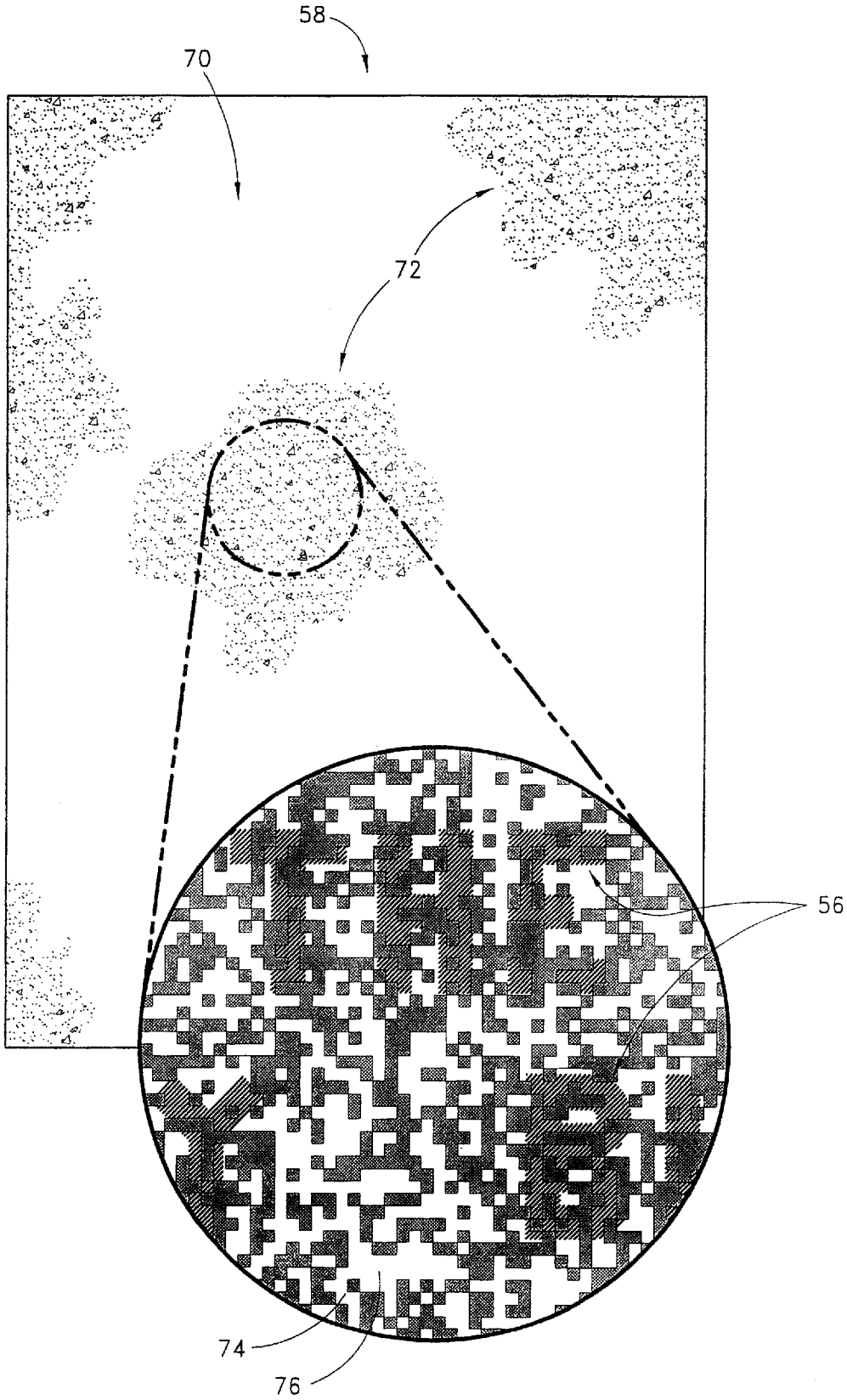
FIG. 12 is a front side view of the sign of FIG. 9 with a close-up view of a portion of the sign of FIG. 9 showing the letters of the clue hidden behind the printed color screen pattern.
Figure 13:
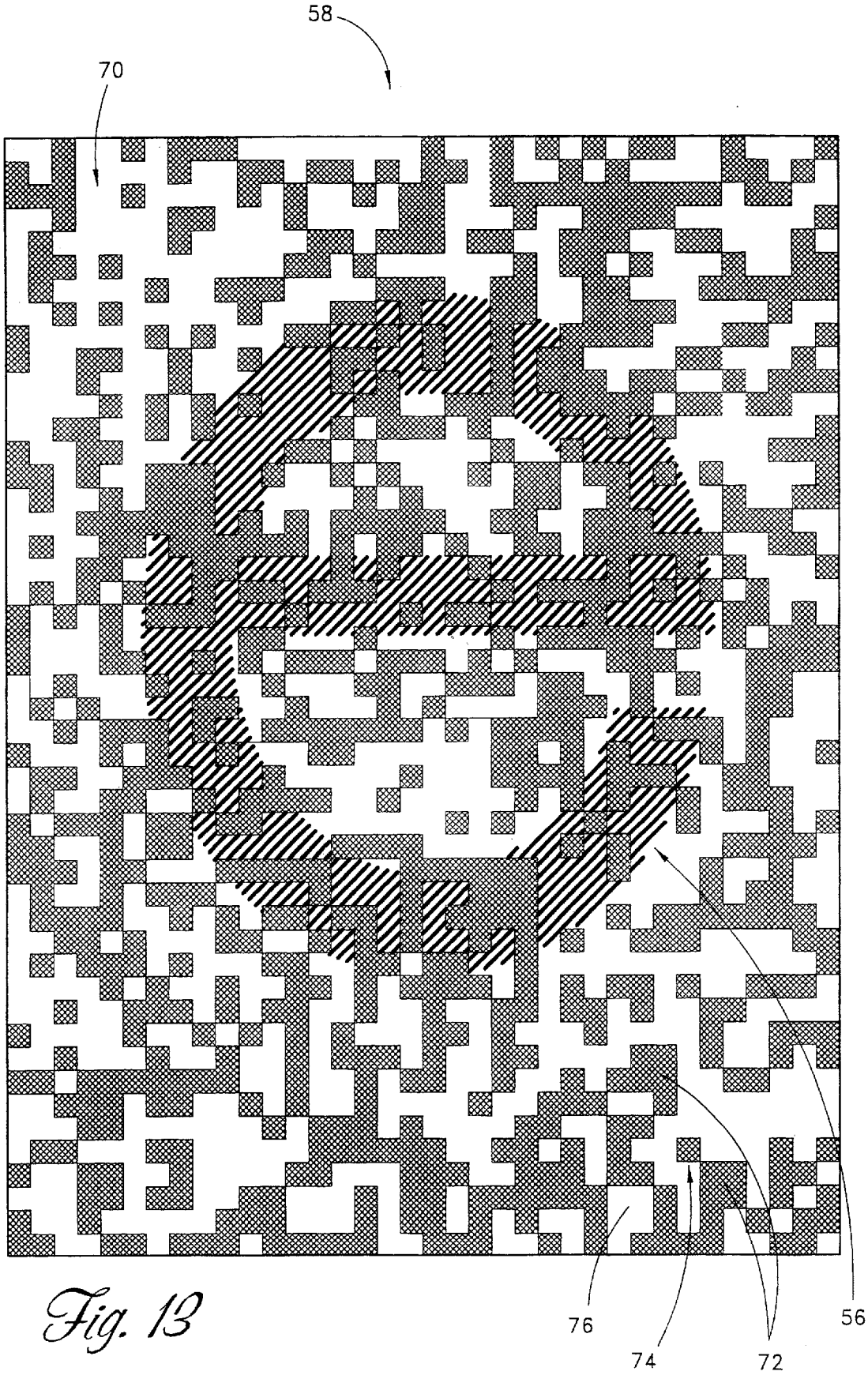
FIG. 13 is a close-up view of the letter "e" of a clue, printed on a sign and hidden by a printed color screen pattern.

As seen in FIG. 1, the amusement park 20 establishes interactive clue sources 58 at various locations 60 through out the park. These locations 60 can be randomly selected locations around the park 20, or strategically selected locations near food vendors 62, shops 64, rides 66 and attractions 68. FIGS. 8–13 illustrate the interactive clue sources of the preferred embodiment. In the particular preferred embodiment, the interactive clue sources 58 are signs 70 with printed clues 56 hidden within a printed color screen 72 (FIG. 9). The clue 56 is printed in light blue on the sign 70 and then thousands of small red squares 74 are printed in a random pattern 72 over the top of the clue 56. The effect of this color screen 72 is that the clue 56 cannot generally be read without looking through a colored-filter decoder 54. A player using the game glasses 26 will view the sign 70 through the red tint of the glasses 26 (FIG. 10). The red squares 74 will not be distinguishable from the background 76 of the sign 70. The whole sign 70 will appear red except for the clue 56. This enables the player to read the clue 56 while the clue 56 will still be hidden from others in the amusement park 20 who are not playing the game. Additionally, by providing clues 56 through the use of interactive clue sources 58 that remain stationary during the game, multiple players can be playing at the same time.

After receiving the personal game pieces 24,26, the player reads the instructions 30. The instructions 30 direct the player to put on the game glasses 26 and look at the sign 70 near the booth 22 to find the first clue 56. The player is able to view and read the clue 56 from the sign 70. In this embodiment, the signs 70 contain clues 56 that have two parts 78,80. The first part 78 relates to the player's personal game card 24. The second part 80 relates to the location 60 of the next interactive clue source 58.

A player who views a sign 70 using the game glasses 26 sees the clue 56 and is first instructed 78 to scratch off one of the numbered 46 spaces 36 on the personal game card 24. The player scratches off the specified space 82 to reveal a letter 84. The player is excited to get to scratch off a space 82 to try and start solving the puzzle. The second part 80 of the clue 56 hints at the location 60 of the next sign 70 and the player proceeds to that location 60. The cycle is then repeated. The player views the sign 70, scratches off another letter 86, and proceeds. This progression continues until the player has located the necessary interactive clue sources 58 and scratches off the word "END" 42 on the game card 24.

At that point, the player will have revealed multiple letters 38. The player then solves the game card puzzle by unscrambling the letters 38 to discover the prize. The player writes down the name of the prize on the blank lines 50 following the words "I WIN A" 48. The player then proceeds to the finish location 88 to claim the prize. The player exchanges the personal game card 24 for the prize. The prize may be a toy or some other typical amusement park 20 prize.

There are multiple alternative embodiments for the interactive treasure hunt game. The particular embodiment described above located the game in an amusement park. Other embodiments of the interactive treasure hunt game may be located in entertainment, educational, or other facilities. These facilities include, but are not limited to, amusement parks, carnivals, fairs, theme parks, fun centers, family entertainment centers, restaurants, parks, camps, national parks, malls, zoos, schools, libraries, museums or other public and private facilities. Still other embodiments are conceived that locate the interactive treasure hunt game wholly or partly on the Internet or in the domain of the World Wide Web. In that event, clues hint at various internet addresses or websites which participants try to guess and then find to get more clues or to find a final prize or treasure. Some facilities, like museums, may choose to offer a treasure hunt game free of charge.

Other embodiments of the game can include different combinations of interactive clue sources and personal game pieces. Many combinations are possible that allow for play by multiple contemporaneous and consecutive players and involve a high level of player interaction while preventing non-participants from entering the game. The game card puzzle described above could be any number of different kinds of puzzles. Other puzzles include different forms of scratch-off puzzles, a crossword puzzle, a fill-in-the-blank, stamping or punching letters or numbers on a card, a word search, actual puzzle pieces, a book of clues, or any other interactive task or puzzle.

The game glasses described above are used by the player to interact and receive clues from the interactive clue sources. Many other personal game pieces are conceived which will allow a player to interact in different ways with different types of interactive clue sources to receive a clue. One embodiment of the invention is to use glasses with polarized lenses as a personal game piece, in connection with a sign hidden behind a polarized mirror as an interactive clue source. Non-participants can only see their reflection in the mirror, whereas the player can see the clue. Another embodiment uses a small mirror as a personal game piece for use with signs printed in mirror-image text, so that the words appear backwards on the signs. The signs can only be read easily by looking at their reflections in the mirror. Other embodiments include using game pieces or other auxiliary devices capable of interacting with a computer or other electronic device functioning as part of an interactive clue source in order to obtain a clue. Examples of such game pieces include cards or objects with bar codes, scantron bubbles, punched holes, magnetic strips, infra red signals, or other signals. A map of the facility may be included as a personal game piece. Other embodiments of the interactive treasure hunt game may not require the use of a personal game piece. In such embodiments, players can use a code or password to retrieve clues. If the facility is not charging for the game, the interactive clue sources can be designed to provide the clues to any interested person with or without a personal game piece. An example is an interactive clue source in a museum that provides information about an exhibit, and clues as to the location of the next exhibit, to any one who is interested, regardless of whether they have a personal game piece.

Different combinations of interactive clue sources and personal game pieces produce variations on the style of play. A personal game piece could be a clue booklet and the interactive clue sources could simply be signs in fixed locations that refer the player to the correct clues in the booklet. Another embodiment of the game is more of a race where players have their game cards time stamped and compete to solve the game in the fastest time. Other embodiments can have audio, video, or computerized interactive clue sources. Speakers, headphones, telephones, LCD screens, video monitors, computers, and other equipment can be used individually or in various combinations to provide information to the players. These clue sources can be activated by punching in a code or by using a personal game piece to interface the clue source. The interactive clue sources can repeat the same clue to every player, or can be programmed to interact differently with different players. This can be useful to increase or decrease the level of difficulty of the clues depending upon the age or skill of the player. Different players can enter a different code, or the players' personal game pieces can be encoded, to interact with the clue sources in a way that the clue source recognizes the player and gives an appropriate clue. The ability to personalize the game to the player makes it possible to create a game with multiple themes and routes using a fixed number of interactive clue sources. For example, just a few of the possible game themes include a murder mystery theme, a detective theme, a spy theme, and a space or time travel theme. The game can be arranged to include a greater or lesser number of clue sources in various orders according to the desires of the facility operators. This type of personal interaction with the players increases the players' enjoyment of the game and allows for multiple variations of the game.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. An interactive treasure hunt game, comprising:

a plurality of interactive clue sources containing clues useful in obtaining a prize, the interactive clue sources being capable of providing game participants with clues, while keeping the clues hidden from non-participants;

one or more personal game pieces for assisting participants' interactions with the interactive clue sources in order to solve the game and/or find the treasure, wherein at least one of said personal game pieces is a game card containing a puzzle about the prize, comprising on the first side game instructions and on the second side a plurality of letters hidden under a coating capable of being scratched off, each being numbered consecutively.

2. The interactive treasure hunt game of claim 1, further including a map of the facility where the game is to be played.

3. The interactive treasure hunt game of claim 1, wherein at least one of said interactive clue sources consists of clues hidden within a printed color screen so as to be viewed only with a colored-filter decoder.

4. The interactive treasure hunt game of claim 3, wherein at least one of the said personal game pieces is a colored-filter decoder.

5. The interactive treasure hunt game of claim 4, wherein said colored-filter decoder is capable of being worn in front of the eyes as glasses.

6. The interactive treasure hunt game of claim 4, wherein said prizes comprise toys, stuffed animals, gift certificates, food, information, or any other similar prizes.

7. A method of playing an interactive treasure hunt game, comprising the steps of:

obtaining one or more personal game pieces from a start location;

obtaining clues from interactive clue sources through an interactive means using at least one personal game piece;

solving clues and completing the tasks revealed by the interactive clue sources;

locating successive interactive clue sources using revealed clues;

claiming a prize at a final location after solving all the puzzles or clues.

8. The method of playing an interactive treasure hunt game of claim 7, where at least one of said personal game pieces is a game card containing a puzzle useful for obtaining the prize, comprising on the first side game instructions and on the second side a plurality of letters hidden under a coating capable of being scratched off, each being numbered consecutively.

9. The method of playing an interactive treasure hunt game of claim 7, wherein at least one of the personal game pieces is a colored-filter decoder and where obtaining clues from an interactive clue source is accomplished by using said colored-filter decoder to view clues hidden within a printed color screen.

10. The method of playing an interactive treasure hunt game of claim 7, wherein said tasks revealed by said interactive clue sources comprise instructions relating to the use of at least one of said personal game pieces.

11. The method of playing an interactive treasure hunt game of claim 7, wherein said clues revealed by said interactive clue sources comprise instructions for progressing to another interactive clue source.

12. The method of playing an interactive treasure hunt game of claim 8, wherein the said instructions relating to use of said personal game piece comprise scratching off the coating covering certain letters.

13. The method of playing an interactive treasure hunt game of claim 12, wherein the player, after revealing the correct letters, attempts to unscramble the letters in order to discover the prize to be won.

14. The method of playing an interactive treasure hunt game of claim 7, wherein said prizes comprise toys, stuffed animals, gift certificates, food, information, or any other similar prizes.

15. A method of laying an interactive treasure hunt game, comprising the steps of:

obtaining at least one game piece from a start location;

using a decoder to obtain clues from a plurality of clue sources provided at different locations throughout a facility;

using the clues and/or the game piece to sequentially locate and obtain additional clues from said plurality of clue sources located throughout said facility;

using said at least one game piece to record the completion of each said clue, clue source and/or clue location; and redeeming said game piece or a prize.

16. The method of playing an interactive treasure hunt game of claim 15, wherein at least one of said game pieces com rises a game card containing a puzzle useful for obtaining the prize, comprising on the first side game instructions and on the second side a plurality of letters hidden under a coating capable of being scratched off.

17. The method of playing an interactive treasure hunt game of claim 15, wherein at least one of the game pieces comprises a colored-filter decoder and where step of obtaining clues from a clue source is accomplished using said colored-filter decoder to view clues hidden within a printed color screen.

18. The method of playing an interactive treasure hunt game of claim 15, wherein at least one of said clues comprises instructions how and/or where to record a clue or clue location on said game piece.

19. The method of playing an interactive treasure hunt game of claim 18, wherein said clue includes instructions to scratch off a coating covering certain letters on said game piece.

20. The method of playing an interactive treasure hunt game of claim 15, wherein at least one of said clues comprises instructions how and/or where to find another clue source.

21. The method of playing an interactive treasure hunt game of claim 20, comprising the further step of time-stamping said game piece at the start and end of said treasure hunt game.

* * * * *